US009133765B2

(12) United States Patent
Hofbauer

(10) Patent No.: US 9,133,765 B2
(45) Date of Patent: Sep. 15, 2015

(54) SYMMETRIC OPPOSED-PISTON, OPPOSED-CYLINDER ENGINE

(71) Applicant: EcoMotors, Inc., Allen Park, MI (US)

(72) Inventor: Peter Hofbauer, West Bloomfield, MI (US)

(73) Assignee: EcoMotors, Inc., Allen Park, MI (US)

( * ) Notice: Subject to any disclaimer, the term of this patent is extended or adjusted under 35 U.S.C. 154(b) by 144 days.

(21) Appl. No.: 13/793,083

(22) Filed: Mar. 11, 2013

(65) Prior Publication Data

US 2013/0276762 A1 Oct. 24, 2013

Related U.S. Application Data

(60) Provisional application No. 61/625,815, filed on Apr. 18, 2012.

(51) Int. Cl.

| | |
|---|---|
| ***F01B 7/12*** | (2006.01) |
| ***F02B 75/28*** | (2006.01) |
| ***F02B 75/24*** | (2006.01) |
| *F02B 75/02* | (2006.01) |
| *F01B 7/14* | (2006.01) |

(52) U.S. Cl.

CPC ..... *F02B 75/28* (2013.01); *F02B 75/246* (2013.01); *F02B 75/282* (2013.01); *F01B 7/14* (2013.01); *F02B 2075/025* (2013.01); *F02B 2075/027* (2013.01)

(58) Field of Classification Search

CPC .. F02B 75/28; F02B 2075/027; F02B 75/282; F02B 2075/025; F01B 7/14

USPC ..... 123/51 R

See application file for complete search history.

(56) References Cited

U.S. PATENT DOCUMENTS

| | | | | |
|---|---|---|---|---|
| 6,170,443 | B1 * | 1/2001 | Hofbauer | 123/51 B |
| 7,469,664 | B2 | 12/2008 | Hofbauer | |
| 2009/0165754 | A1 * | 7/2009 | Howard | 123/51 BC |
| 2010/0224162 | A1 * | 9/2010 | Hofbauer | 123/196 R |

(Continued)

FOREIGN PATENT DOCUMENTS

| | | | |
|---|---|---|---|
| DE | 2849790 | A1 | 5/1979 |
| DE | 4135386 | A1 | 12/1992 |

OTHER PUBLICATIONS

Accessory Belts for 3000GT/Stealth, at least 2010 and likely 2007, 3SX Performance Automotive, Inc., p. 1.*

(Continued)

*Primary Examiner* — Lindsay Low
*Assistant Examiner* — Charles Brauch
(74) *Attorney, Agent, or Firm* — Barnes & Thornburg LLP

(57) ABSTRACT

An opposed-piston, opposed-cylinder engine is disclosed that has the pistons symmetrically arranged in the opposed cylinders. In one embodiment, the inner pistons are exhaust pistons and the outer pistons are intake pistons. Alternatively, the inner pistons are intake pistons and the outer pistons are exhaust pistons. The pistons are coupled to the crankshaft that is situated between the opposed cylinders. Central axes of the two cylinders are offset by a predetermined distance. The connecting rods that couple between the crankshaft and the pistons are arranged adjacent to each other on journals of the crankshaft. The journal to which the pushrods couple is not a split-pin type. Instead, it is one that has a common central axis. Furthermore, the crankshaft is a one-piece or unitary structure.

18 Claims, 7 Drawing Sheets

(56) References Cited

U.S. PATENT DOCUMENTS

| | | | |
|---|---|---|---|
| 2012/0073538 | A1 | 3/2012 | Hofbauer |
| 2012/0207415 | A1 | 8/2012 | Tusinean |
| 2012/0247419 | A1 | 10/2012 | Hofbauer |

OTHER PUBLICATIONS

"The Application of the Two-Stroke heavy-Oil Engine to Aircraft Propulsion," W.S.Burn, Institute of Engineers and Shipbuilders, Transactions, published 1940.

* cited by examiner

SYMMETRIC OPPOSED-PISTON, OPPOSED-CYLINDER ENGINE

CROSS REFERENCE TO RELATED APPLICATIONS

The present application claims priority benefit from U.S. provisional patent application 61/625,815 filed 18 Apr. 2012.

FIELD

The present disclosure relates to an architectural arrangement for an opposed-piston, opposed-cylinder engine.

BACKGROUND AND SUMMARY

An opposed-piston, opposed-cylinder (OPOC) is disclosed in U.S. Pat. No. 6,170,443, which is incorporated herein in its entirety. The configuration in '443 has an asymmetrical arrangement of the pistons. That is, in one of the cylinders, the intake piston, i.e., that piston that uncovers intake ports, is located closer to the crankshaft than the exhaust piston. In the other cylinder, the exhaust piston is located closer to the crankshaft than the intake piston. Such an arrangement provides some distinct advantages such as nearly perfect balancing of the engine. However, some small detractors result due to the asymmetric arrangement and the phase offset between the intake and the exhaust pistons, the offset being provided for scavenging purposes. In particular, the crankshaft is a split-pin design. That is, the journals of the crankshaft, to which the pistons of the two cylinders couple, cannot be smooth cylinders to which two connecting rods couple, but instead includes two cylindrical crankpins that are offset from each other (as shown in FIGS. 9 and 10b in '443). This is a more costly and less robust design than the simpler single cylindrical journals to which two connecting rods couple. The highest stress location in a crankshaft tends to be located at the interface between the journal and the web portion of the crankshaft. There are techniques that can be used to harden that portion of the crankshaft such as: induction hardening or rolling. These are difficult and expensive for a split-pin design.

Additionally, as the inner pistons couple to the crankshaft in a different manner than the outer pistons, the '443 engine has four distinctly different pistons: an inner intake piston, an outer intake piston, an inner exhaust piston, and an outer exhaust piston. To reduce engineering costs, manufacturing costs, and complexity, it is desirable to have as few different parts as possible. Other detractors include optimizing two combustion chamber shapes and port heights, i.e., one for each of the two cylinders. One combustion chamber is formed by an inner intake piston and an outer exhaust piston and the other is formed by an outer intake piston and an inner exhaust piston. Part of the reason for the inconsistency from one cylinder to the other cylinder is due to differences in the flow characteristics by virtue of the asymmetric nature of the induction and exhaust systems.

To overcome these detractors, an OPOC with a symmetrical arrangement of the pistons is disclosed in U.S. Pat. No. 7,469,664, which is incorporated herein in its entirety. The two cylinders of the OPOC in '664 are collinear meaning that that the central axes of the two cylinders lay on essentially the same line. In the engine in '664, two connecting rods, that mesh together, couple to a single journal; this arrangement is commonly referred to as a forked rod design. Because the forked rod must be slid over the journal, the crankshaft is a "build-up", meaning that it is assembled of multiple parts with the final assembly accomplished after the connecting rods have been installed. Such a crankshaft is more expensive to manufacture and assemble.

To overcome issues associated with a multi-piece crankshaft, alternative coupling strategies for inner pistons and for outer pistons are disclosed in commonly-assigned, published U.S. applications: 2012/0207415 A1 filed 3 Feb. 2012 and 2012/0247419 A1 filed 2 Apr. 2012. Although such disclosed solutions provide many advantages for the OPOC engine and provide the desired symmetrical arrangement of the pistons, these coupling arrangements are unique in the industry and are to date untested. For production purposes in the nearer term, some manufacturers prefer to use technologies that are well developed and thus are reticent to adopt the coupling arrangements disclosed in applications '415 and '419 until further proven.

An advantageous OPOC configuration, according to some embodiments disclosed herein, relies on proven mechanical technologies, provides a symmetric arrangement of the pistons, and uses a unitary crankshaft.

An internal combustion engine is disclosed that includes a unitary crankshaft, a block into which the crankshaft is mounted, the block defining two cylinders wherein a first of the two cylinders is arranged substantially opposite a second of the two cylinders with respect to the crankshaft and a central axis of the first cylinder is offset from a central axis of the second cylinder by a predetermined distance, a first intake piston and a first exhaust piston inserted into the first cylinder with the first exhaust piston closer to the crankshaft than the first intake piston, and a second intake piston and a second exhaust piston inserted into the second cylinder with the second exhaust piston closer to the crankshaft than the second intake piston. The engine has a first pushrod that couples between a central journal of the crankshaft and the first exhaust piston; and a second pushrod that couples between the central journal of the crankshaft and the second exhaust piston wherein the first pushrod and the second pushrod are adjacent to each other and the predetermined distance that the cylinders are offset is substantially equal to a distance between the pushrods taken along an axis of rotation of the crankshaft.

In some embodiments, a first pair of shell bearings are placed on the central journal with the first pair of shell bearings located between the central journal and the first pushrod and a second pair of shell bearings placed on the central journal with the second pair of shell bearings located between the central journal and the second pushrod wherein the first pair of shell bearings is adjacent to the second pair of shell bearings. Alternatively, a single part of shell bearings are placed on the central journal with the first and second pushrods are coupled to the outer surface of the shell bearings. In some embodiments, at least one of the pair of shell bearings includes an outwardly extending tab; the first pushrod has a pocket defined on a surface of the first pushrod that nests with the shell bearings; and the tab engages with the pocket.

The crankshaft has at least five journals: a central eccentric journal, a front eccentric journal, a rear eccentric journal, a front main journal having an axis of rotation collinear with an axis of rotation of the crankshaft, and a rear main journal having an axis of rotation collinear with the axis of rotation of the crankshaft. The engine also includes: a first rear pullrod that couples between the rear journal of the crankshaft and the first intake piston, a first front pullrod that couples between the front journal of the crankshaft and the first intake piston, a second rear pullrod that couples between the rear journal of the crankshaft and the second intake piston, and a second front pullrod that couples between the front journal of the crankshaft and the second intake piston. In some embodiments, the engine further includes: a first rear pair of shell bearings placed on the rear journal with the first rear pair of shell bearings located between the rear journal and the first rear pullrod, a second rear pair of shell bearings placed on the rear journal with the second rear pair of shell bearings located between the rear journal and the second pullrod wherein the first rear pair of shell bearings is adjacent to the second rear pair of shell bearings, a first front pair of shell bearings placed on the front journal with the first front pair of shell bearings located between the front journal and the first front pullrod, and a second front pair of shell bearings placed on the front journal with the second front pair of shell bearings located between the front journal and the second pullrod wherein the first front pair of shell bearings is adjacent to the second front pair of shell bearings. Some embodiments include a rear pair of shell bearings placed on the central journal wherein the first and second rear pullrods are coupled to the outer surface of the rear pair of shell bearings and a front pair of shell bearing placed on the central journal wherein the first and second front pullrods are coupled to the outer surface of the front pair of shell bearings. In some alternatives, at least one of the rear pair of shell bearings includes an outwardly extending tab; the first rear pullrod has a pocket defined on a surface of the first rear pullrod that nests with the shell bearings; the tab associated with the rear pair of shell bearings engages with the pocket associated with the first rear pullrod; at least one of the front pair of shell bearings includes an outwardly extending tab; the first front pullrod has a pocket defined on a surface of the first front pullrod that nests with the shell bearings; and the tab associated with the front pair of shell bearings engages with the pocket associated with the first front pullrod.

The crankshaft in some embodiments the crankshaft is a unitary or one-piece crankshaft. The front and rear eccentric journals have a substantially identical crank throw and substantially equal phasing. The central journal has a crank throw greater than the crank throw of the front and rear eccentric journals and is offset between 150 to 180 degrees with respect to the front and rear eccentric journals.

Also disclosed is an internal combustion engine having a unitary crankshaft, a block into which the crankshaft is mounted, the block defining two cylinders wherein a first of the two cylinders is arranged substantially opposite a second of the two cylinders with respect to the crankshaft, two substantially identical inner pistons, one of which is inserted into the first cylinder and the other of which is inserted into the second cylinder, and two substantially identical outer pistons, one of which is inserted into the first cylinder and the other of which is inserted into the second cylinder wherein the inner pistons are located nearer the crankshaft than the two outer pistons. In some alternatives, a central axis of the first cylinder is offset from a central axis of the second cylinder by a predetermined distance. A first pushrod couples between a central journal of the crankshaft and the inner piston in the first cylinder. A second pushrod couples between the central journal of the crankshaft and the inner piston in the second cylinder. The first pushrod and the second pushrod are adjacent to each other and the predetermined distance that the cylinders are offset is substantially equal to a distance that first and second pushrods are displaced from each other taken along a central axis of the crankshaft.

The two inner pistons are exhaust pistons and the two outer pistons are intake pistons in one alternative. In another alternative, the two inner pistons are intake pistons, and the two outer pistons are exhaust pistons.

A plurality of ports are defined in each of the two cylinders with an inner plurality of ports that are located a first predetermined distance from the crankshaft and an outer plurality of ports that are located a second predetermined distance from the crankshaft with the second predetermined distance being roughly double the first predetermined distance. The engine further includes a first manifold system fluidly coupled to the inner plurality of ports and a second manifold system fluidly coupled to the outer plurality of ports. In some embodiments, the first manifold system is an intake system and the second manifold system is an exhaust system. In other embodiments, the first manifold system is an exhaust system and the second manifold system is an intake system.

In another embodiment, an engine has a crankshaft and a block into which the crankshaft is mounted. The block defines two cylinders with a first of the two cylinders arranged substantially opposite a second of the two cylinders with respect to the crankshaft and a central axis of the first cylinder is offset from a central axis of the second cylinder by a first predetermined offset. The engine includes: a plurality of inner ports defined in the first cylinder with an inner edge of the inner ports located at a first predetermined distance from the crankshaft and an outer edge of the inner ports located at a second predetermined distance from the crankshaft, a plurality of inner ports defined in the second cylinder with an inner edge of the inner ports located at the first predetermined distance from the crankshaft and an outer edge of the inner ports located at the second predetermined distance from the crankshaft, a plurality of outer ports defined in the first cylinder with an inner edge of the outer ports located at a third predetermined distance from the crankshaft and an outer edge of the outer ports located at a fourth predetermined distance cylinder from the crankshaft, and a plurality of outer ports defined in the second cylinder with an inner edge of the outer ports located at the third predetermined distance from the crankshaft and a outer edge of the outer ports located at the fourth predetermined distance from the crankshaft. In some embodiments, the engine further includes: a plurality of outermost ports defined in the first cylinder with an inner edge of the outermost ports located at a fifth predetermined distance from the crankshaft and an outer edge of the outermost ports located at a sixth predetermined distance from the crankshaft and a plurality of outermost ports defined in the second cylinder with an inner edge of the outermost ports located at the fifth predetermined distance from the crankshaft and an outer edge of the outermost ports located at the sixth predetermined distance from the crankshaft.

In some embodiments: the pluralities of inner ports are exhaust ports; the pluralities of outer ports are primary intake ports; the plurality of outermost ports is secondary intake ports; and all ports are shaped substantially as one of: a rectangle, a parallelogram, an oval, and a circle.

The various disclosed embodiments include one or more of the following advantages:

a crankshaft without split pins;

identical left and right cylinder blocks;

only first-order unbalanced forces that can be overcome by weighting of the crankshaft such that the center of gravity is offset with respect to the axis of rotation of the crankshaft;

symmetric arrangement of the pistons with common inner pistons and common outer pistons, i.e., two each of two piston designs as contrasted to some prior designs that had one each of four piston designs;

the intake and exhaust flanges and ports are symmetrical;

coupling of connecting rods to the journals draws upon well-known technologies used in the industry for decades;

a stiffer, unitary crankshaft as contrasted with a built-up crankshaft or split-pin crankshafts used in some prior designs; and substantially identical combustion chamber configurations in the two cylinders.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
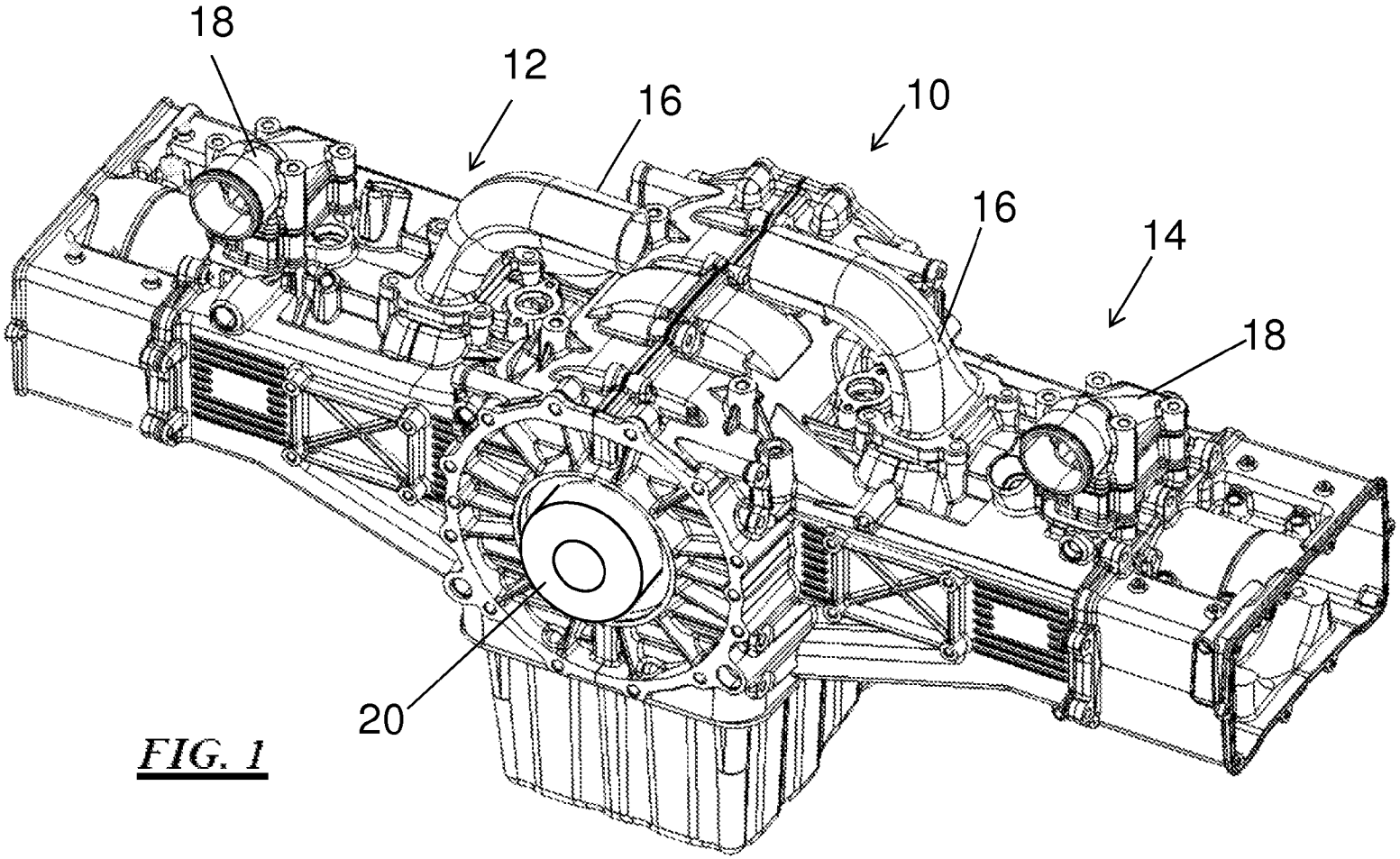
FIG. 1 is an isometric view of an OPOC engine according to embodiments of the present disclosure.

An isometric view of an engine 10 according to an embodiment of the present disclosure is shown in FIG. 1. Engine 10 has a left cylinder 12 and a right cylinder 14. Engine 10 has an exhaust system to conduct the exhaust from inside the cylinders; ducts 16 are part of the exhaust system. Air is provided to the cylinders through an intake system with ducts 18 being part of the intake system. Engine 10 has a crankshaft 20. In FIG. 1, a single intake per cylinder is illustrated. Alternatively, each cylinder has two intakes: one fluidly coupled to primary intake ports and one fluidly coupled to secondary intake ports.

Figure 2:
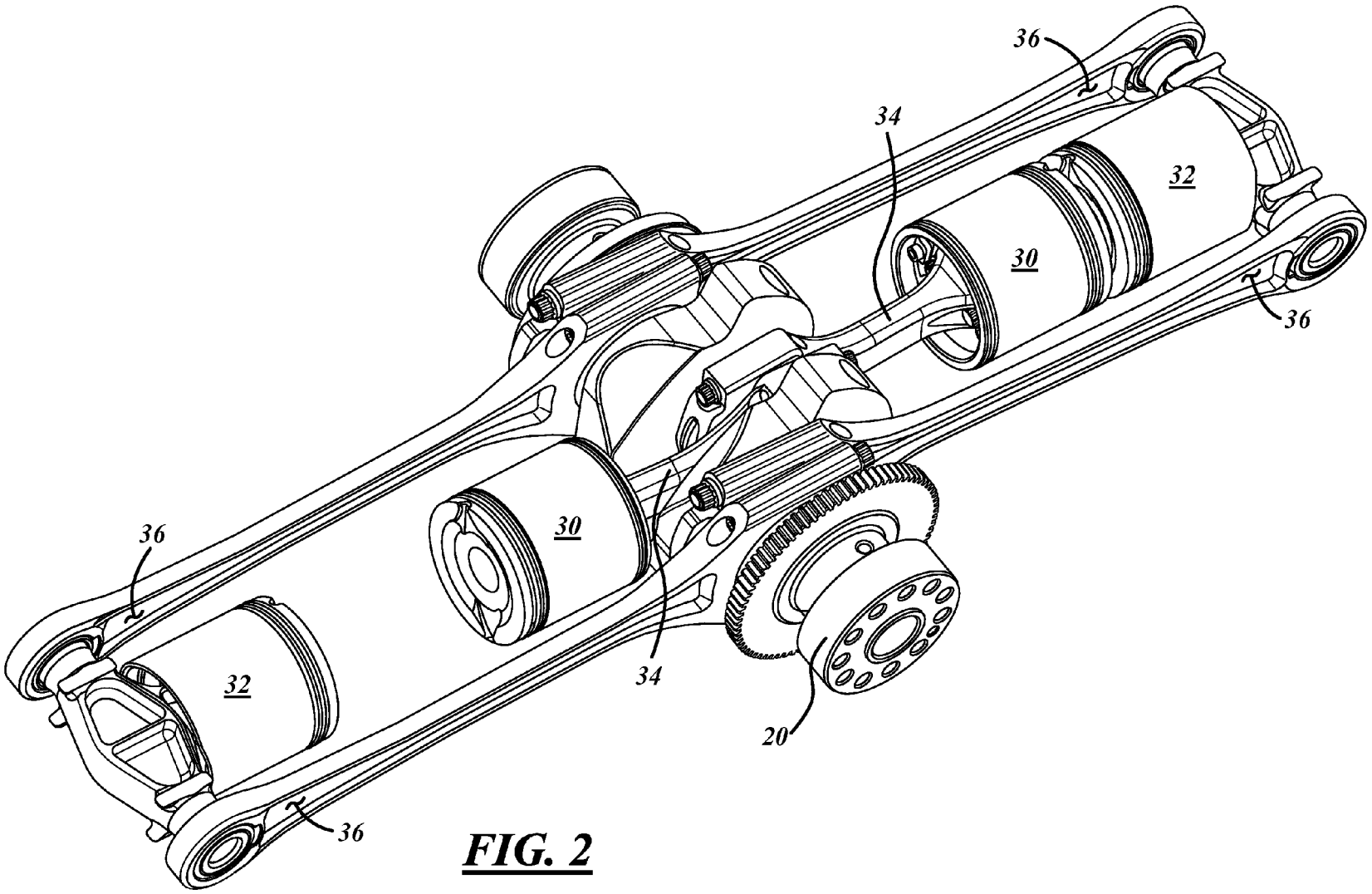
FIG. 2 is an isometric view a crank train of the engine of FIG. 1.

Referring now to FIG. 2, a crank train of engine 10 is shown. Crankshaft 20 couples with inner pistons 30 via pushrods 34 and to outer pistons 32 via pullrods 36. In one embodiment, inner pistons 30 are exhaust pistons and outer piston 32 are intake pistons. Alternatively, inner pistons 30 are intake pistons and outer pistons 32 are exhaust pistons.

Figure 3:
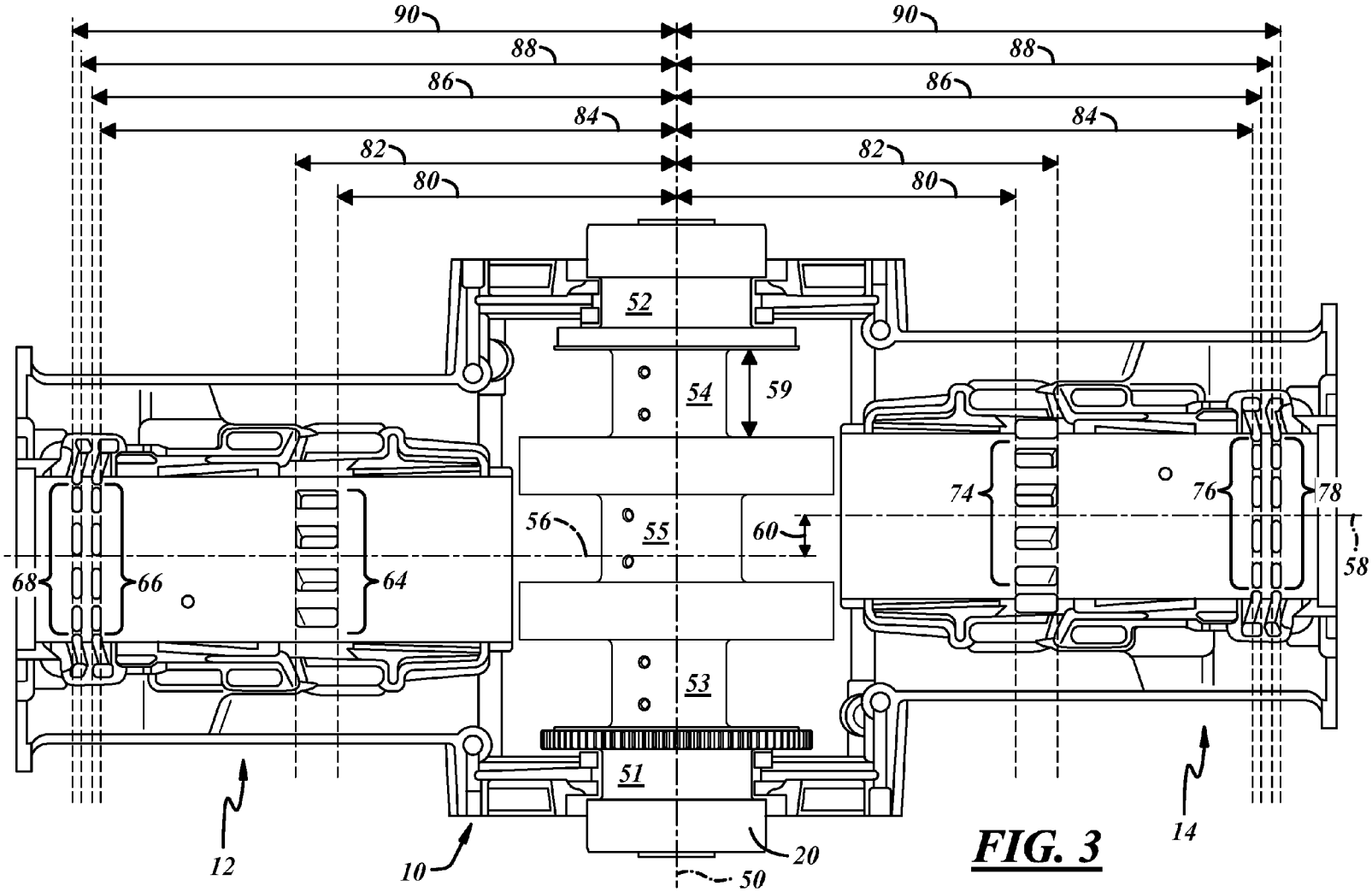
FIG. 3 is a cross-sectional plan view of the cylinder liner and the crankshaft of the engine of FIG. 1.

In FIG. 3, a horizontal, cross section of engine 10 is shown. Crankshaft 20 has a front main journal 51, a rear main journal 52. An axis of rotation 50 of crankshaft 20 is collinear with the axis of rotation of journals 51 and 52. Crankshaft 20 also has a front eccentric journal 53 and a rear eccentric journal 54. The journals are noticeably eccentric as their center does not line up with centerline 50, even in this two-dimensional illustration. A center eccentric journal 55 of crankshaft 20 appears collinear with centerline 50 in FIG. 3. However, in the view in FIG. 3, center journal 55 is below the plane of the plane of cross section. A center axis 56 of the left cylinder and a center axis 58 of the right cylinder are offset as shown by 60.

A plurality of inner ports 64 are defined in cylinder 12 and a plurality of inner ports 74 are defined in cylinder 14. Cylinder 12 also defines a plurality of outer ports 66; cylinder 14 defines a plurality of outer ports 76. In the embodiment shown in FIG. 3, cylinder 12 defines a plurality of outermost ports 68 and cylinder 14 defines a plurality of outermost ports 78. In the embodiment in FIG. 3, inner ports 64 and 74 are exhaust ports. Outer ports 66 and 76 are primary intake ports and outermost ports 68 and 78 are secondary intake ports. In another alternative, there is a single plurality of intake ports. In another alternative in which the intake pistons are closer to the crankshaft than the exhaust pistons, intake ports are located in the region where inner ports 64 and 74 are located and exhaust ports are located in the region where outer and outermost ports 66, 68, 76, and 78 are located.

The ports in FIG. 3 are symmetrically arranged. That is, an outer edge of inner ports 64 and 74 are located distance 82 from the axis of rotation 50 of crankshaft 20. An inner edge of inner ports 64 and 74 are located a distance 80 from axis 50. Additionally:

inner edge of outer ports 66 and 76 are located a distance 84 from axis 50;

outer edge of outer ports 66 and 76 are located a distance 86 from axis 50;

inner edge of outermost ports 68 and 78 are located a distance 88 from axis 50; and outer edge of outermost ports 68 and 78 are located a distance 90 from axis 50.

When opening ports 64 and 76, the pistons from toward the crankshaft. The port edge first opened is called the upper edge. The outer pistons (not shown) open ports 66, 68, 76, and 78 are opened when the piston moves outwardly.

Figure 4:
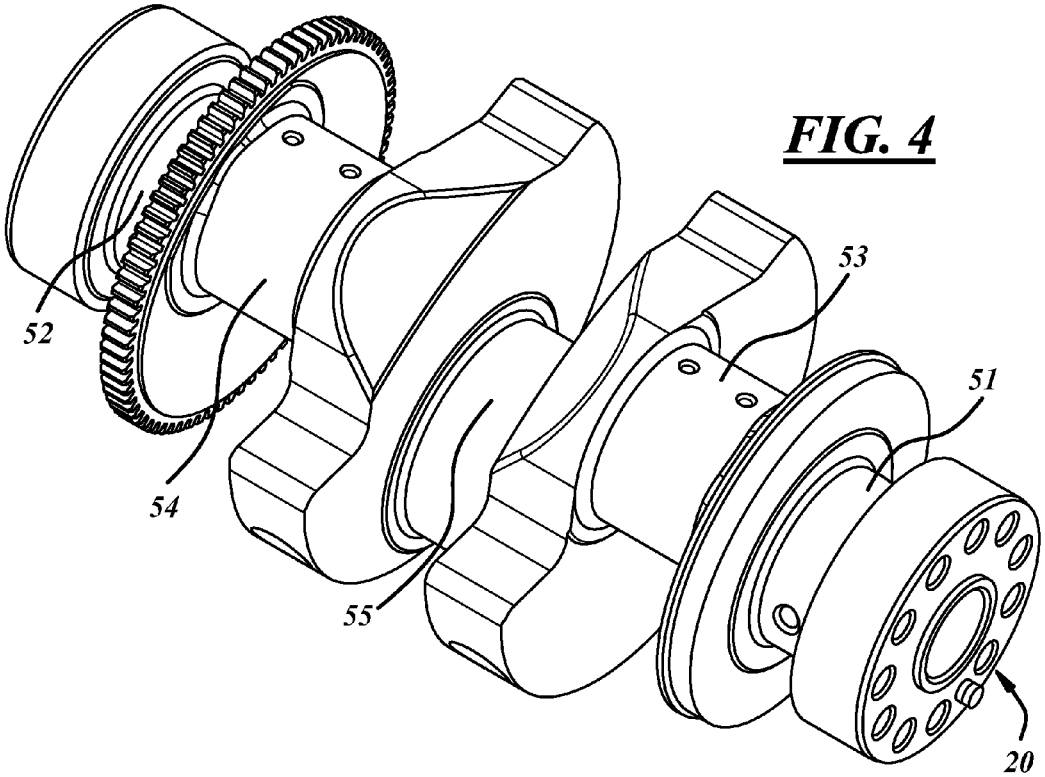
FIG. 4 is an isometric view of the crankshaft of the engine of FIG. 1.

Crankshaft 20 is shown isometrically in FIG. 4. Eccentric journals 53, 54, and 55 are a single cylinder. This contrasts with the split pin design shown in '443, which results from having an asymmetric arrangement of the pistons.

Figure 5:
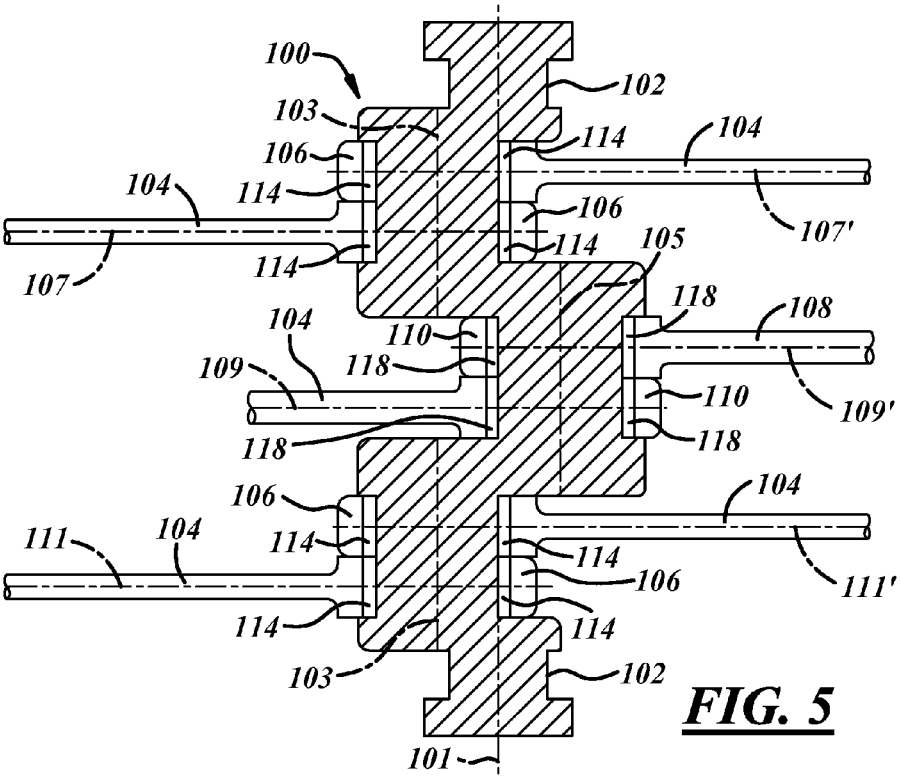
FIGS. 5-7 are illustrations of a portion of the drive train in cross section according to several embodiments.

Several embodiments of the bearing arrangement between the connecting rods and the crankshaft are described below. In FIG. 5, a crankshaft 100 rotates about axis 101 and has main bearings 102. Outer eccentric journals have a center axis of 103 and center eccentric journal has a center axis of 105. Pullrods 104 are placed over the outer eccentric journals and each is secured with a bearing cap 106. A pair of shell bearing 114 (each covering 180° of circumference of the journal), is provided between each of the pullrods 104 and the associated journal. Pushrods 108 are placed over the center eccentric journal and each is secured with a bearing cap 110. A pair of shell bearings 118 is provided between each of the pushrods and the associated journal. Oil passages (not shown) provide oil under pressure to the journals to provide an oil film between the eccentric journals and the shell bearings on the inner surface. Oil may also be provided to the outer surface of the shell bearings to provide a film of oil between the shell bearings and the associated pullrod or pushrod.

As described above, the cylinders are offset by a predetermined distance. A centerline 107, 107', 111, 111' of the pullrods 104 and a centerline 109, 109' of the pushrods 108 are also indicated in FIG. 5. The distance between centerlines 107 and 107', as taken in the vertical direction, is substantially equal to the predetermined distance. The distance between centerlines 107 and 107' and the distance between centerlines 111 and 111' are substantially equal to the predetermined distance, as well.

Figure 6:
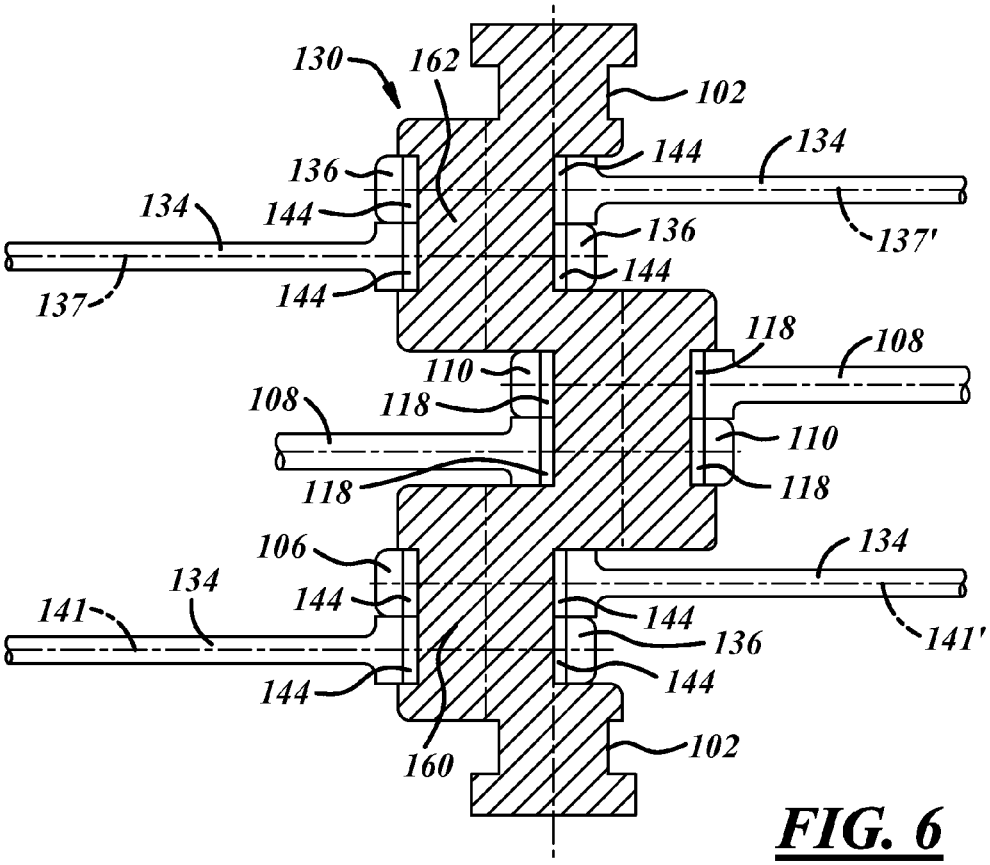

The center eccentric journal carries the forces associated with two opposed pistons. In contrast, there are two outer eccentric journals to carry the forces associated with two opposed pistons. Because the load is shared, the outer eccentric journals can be made shorter than the center eccentric journal. However, the distance between centerlines of adjacent connecting rods should be substantially the predetermined distance, i.e., the offset between the cylinders. Such an arrangement is shown in FIG. 6. A crankshaft 130 has main bearings 102 and a center eccentric journal, which is very similar to those shown in FIG. 5. However, the outer eccentric journals in FIG. 6 are shorter than the outer eccentric journals in FIG. 5. To retain the appropriate spacing between adjacent pullrods 134, they are asymmetric. This can be seen in regard to bearing caps 136. Centerlines 137, 137', 141, 141' of pullrods 134 pass through bearing caps 136 asymmetrically. By providing the arrangement shown in FIG. 6, the total length of the crankshaft is reduced slightly as a result of the shorter outside journals, which results in a smaller engine package and slightly less material to produce as well as a more rigid crankshaft.

Figure 7:
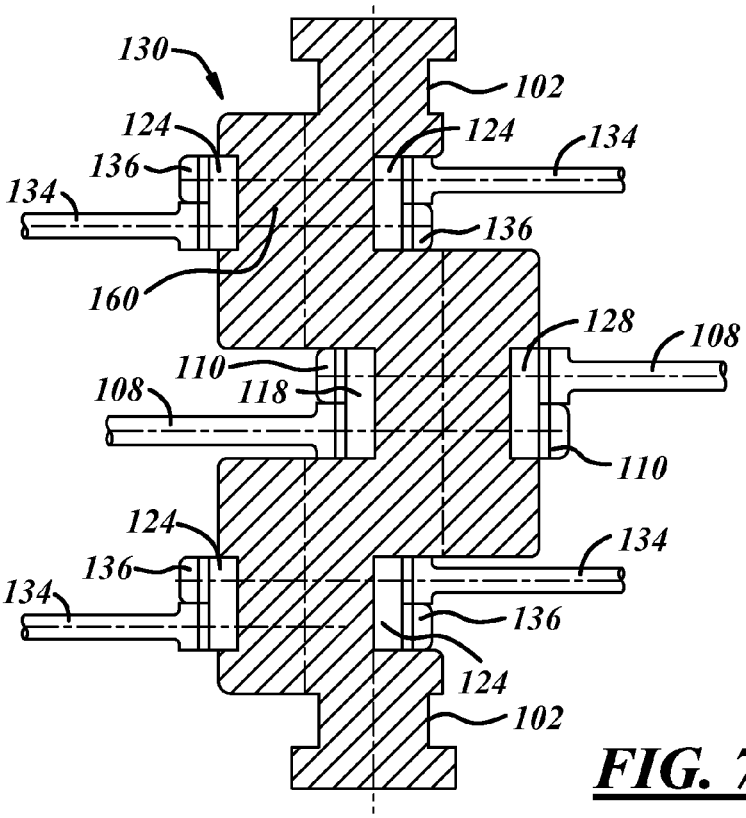

In FIG. 7, instead of having a pair of shell bearings for each connecting rod, adjacent connecting rods share a pair of shell bearings. That is, a single bearing shell pair is placed over the eccentric journal and two adjacent connecting rods are placed over the shell bearing pair and secured via a bearing cap. For example, two pullrods 104 that are secured by bearing caps 136 have a single bearing shell pair 124. Two pushrods 108 that are secured by bearing caps 110 have a single bearing shell pair 128.

The embodiment in FIG. 7 uses crankshaft 130, which is shorter than crankshaft 100 of FIG. 5. The width of front eccentric journal 160 and rear eccentric journal 162 (shown in FIGS. 6 and 7) are shorter than that of the front and rear eccentric journals of crankshaft 100. (What is meant by the width of the journal is shown by numeral 59 in FIG. 3.) To maintain the predetermined distance between the pullrods, the embodiment in FIGS. 6 and 7 use asymmetric pullrods 134. A centerline through pullrods 134 is asymmetric with respect to the base of the pullrods. A great amount of such asymmetry in the pullrods is undesirable. However, a small amount of asymmetry can be tolerated to provide a shorter overall length of the crankshaft and hence a narrower engine and a more rigid crankshaft In FIG. 5, there are two pair of shell bearings on each of the eccentric journals. Alternatively, a single pair of shell bearings is provided with a crankshaft 100, i.e., the bearings of FIG. 6 or 7, with the eccentric journal lengths shorter than that of FIG. 5.

Figure 8:
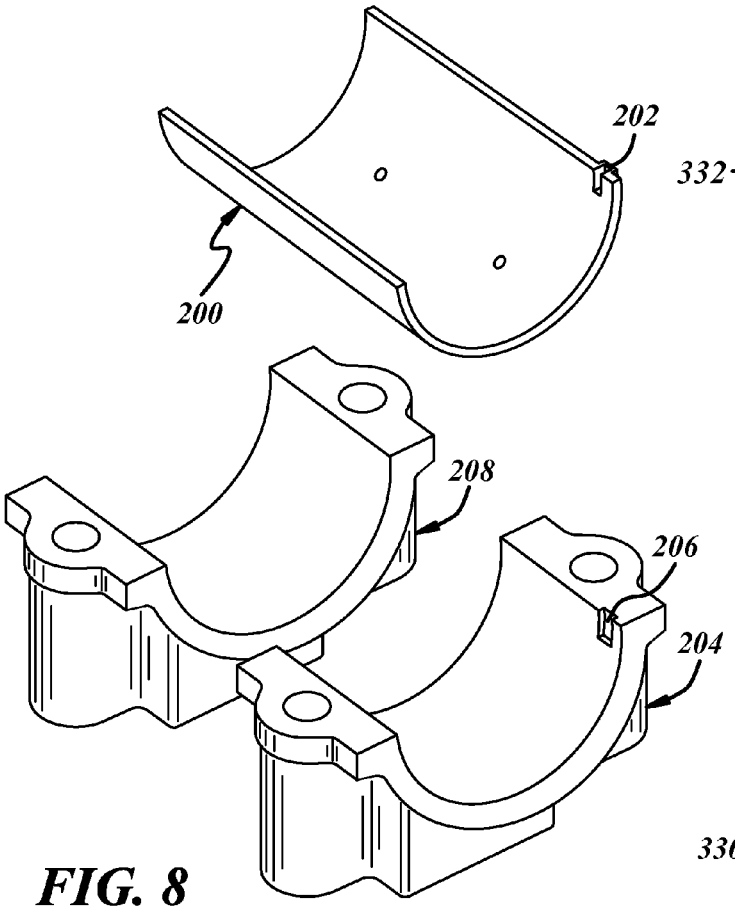
FIG. 8 shows a portion of a bearing assembly.

In one alternative, bearing shells 124 and 128, in FIG. 7, are floating bearings. Alternatively, bearing shells are indexed with one of the connecting rods to prevent relative movement between the bearing shell pair and the connecting rod with which it is indexed. In FIG. 8, a portion of a bearing assembly is shown in an exploded view. A single shell bearing 200 has a tab 202 extending outwardly from the convex side of shell bearing 200. A first bearing cap 204 has a pocket 206. Tab 202 engages, or indexes, with pocket 204 to prevent relative movement of shell bearing 200 with first bearing cap 204. Shell bearing 200 is double wide to accommodate two connecting rods (not shown in FIG. 8; only the bearing caps that couple to the connecting rods are illustrated) that are adjacent to each other. Thus, a second bearing cap 208 is shown in FIG. 8. Because the two connecting rods (not shown) that couple to first and second bearing caps 204, 208 rotate independently of each other, shell bearing 200 engages with only one of the bearing caps (204 in this embodiment) and floats with respect to bearing cap 208. First and second bearing caps 204, 208 are shown in FIG. 8 as being next to each other. However, as assembled, they are on opposite sides of the crankshaft journal to which they couple, such as is illustrated in FIG. 2. In FIG. 2, pushrods 34 extend out in opposite directions so that the bearing caps are also opposite to each other. The same situation applies to pullrods 36 in which adjacent bearing caps (in an axial direction of the crankshaft) are substantially opposite each other with respect to the journal to which they couple.

Figure 9:
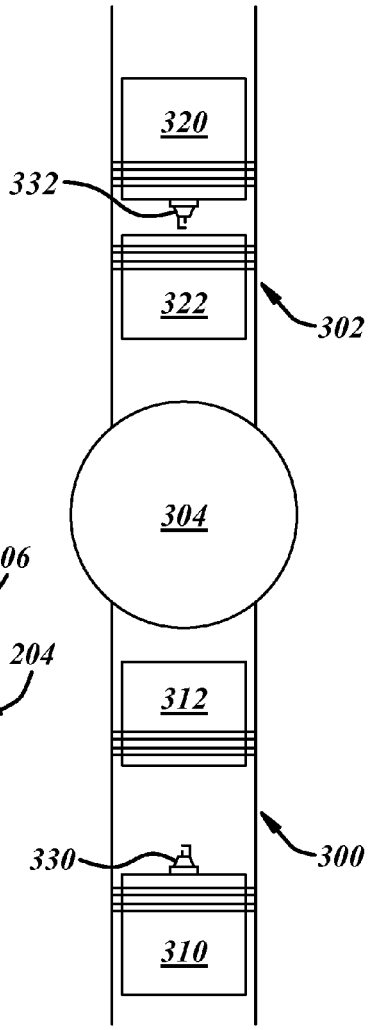
FIG. 9 is an illustration of an OPOC engine with an accessory installed in the outer pistons.
Figure 10:
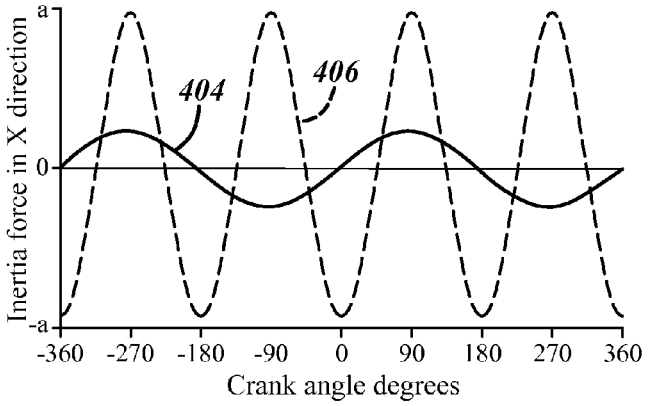
FIG. 10 is a graph showing inertia force in the axial direction of the cylinders for the OPOC engine of FIG. 1 with no balancing measures compared with a conventional in-line, 4-cylinder diesel engine both at the same engine speed.

Referring now to FIG. 9, an OPOC engine is illustrated that has a left cylinder 300 opposite a right cylinder 302 with a crankcase 304 between the two cylinders. An outer piston 310 and an inner piston 312 are disposed in left cylinder 300. An outer piston 320 and an inner piston 322 are disposed in right cylinder 302. As an OPOC engine has no cylinder head, access to the combustion chamber for ancillaries or sensors such as fuel injectors, spark plugs, glow plugs, and pressure transducers, can be a challenge. For some ancillaries or sensors, it is helpful to have access to the center of the combustion chamber as opposed to the periphery. Spark plugs 330 and 332 are shown disposed in pistons 310 and 320, respectively. Other elements could be provided in the piston. If the desire is to mount the spark plug, or other element, in the intake pistons, the symmetric arrangement of the pistons facilitates this. The outer pistons reciprocate a lesser distance than the inner pistons, in most OPOC embodiments. Thus, the element mounted to the outer pistons is accelerated less than it would be if mounted to an inner piston. For most devices that would be mounted to the piston, such as the spark plugs shown, it is likely that wires, springs, or tubes will be coupled between the stationary block and the spark plug which is reciprocating with the piston. It is an advantage for the spark plugs to be mounted in outer pistons because the temperatures are lower at the outer edges and there is easier to access an entry for the wires, springs, or tubes where it is a little less crowded at the outer edges of the piston. Furthermore, replacing spark plugs in an outer piston is much easier than if mounted in an inner piston.

A symmetric OPOC engine is disclosed in commonly-assigned U.S. application 61/549,678, filed 20 Oct. 2011, which is incorporated herein in its entirety. The engine disclosed in '678 has collinear cylinders rather than offset cylinder axes according to embodiments disclosed herein. In '678 and in the present disclosure, the pistons are symmetrically arranged, which provides balance characteristics that are superior to conventional engines, but slightly poorer than the OPOC engine as disclosed in U.S. Pat. No. 6,170,443, which has asymmetrically-arranged pistons. In the present disclosure, the unbalanced forces in the direction of the cylinder axis are only of first order. For applications in which exceptionally low vibration is desired, balancing measures can be applied to the symmetric OPOC by counter weights on the crankshaft (integral with the crankshaft or applied to the crankshaft) and with counter rotating masses with crankshaft speed to attain asymmetric OPOC balancing or better. These measures apply equally well to the '678 and present disclosures.

The inertia forces 404 in the direction of reciprocation of the pistons of the OPOC engine in FIG. 1 is plotted as function of crank angle degrees for a moderate engine speed. Also plotted (with a dashed line) on the same scale at the same engine speed are the inertia forces 406 for a comparable, conventional four-cylinder, four-stroke engine. OPOC engine 10 has about one-quarter of the unbalanced inertia forces compared to that of a conventional in-line, four-cylinder engine. The imbalance in OPOC engine 10 is a first-order imbalance, i.e., at crankshaft speed. The inertia force imbalance in the 1-4 engine is of second order, i.e., the imbalance has two periods in 360 crank degrees. Although the inertia force imbalance for the OPOC engine 10 with symmetrically-arranged pistons is quite small, there are applications in which the least amount of imbalance is desired, e.g., aviation applications, in which measures to lower the imbalance may be desired.

As a first measure to overcome a portion of the imbalance, webs between journals on crankshaft 20 may be designed such that the center of gravity of crankshaft 20 is displaced from the axis of rotation. If crankshaft 20 is weighted to overcome about half of the imbalance due to the reciprocating pistons and rods, the imbalance introduced by the offset center of gravity is shown as curve 412.

Figure 12:
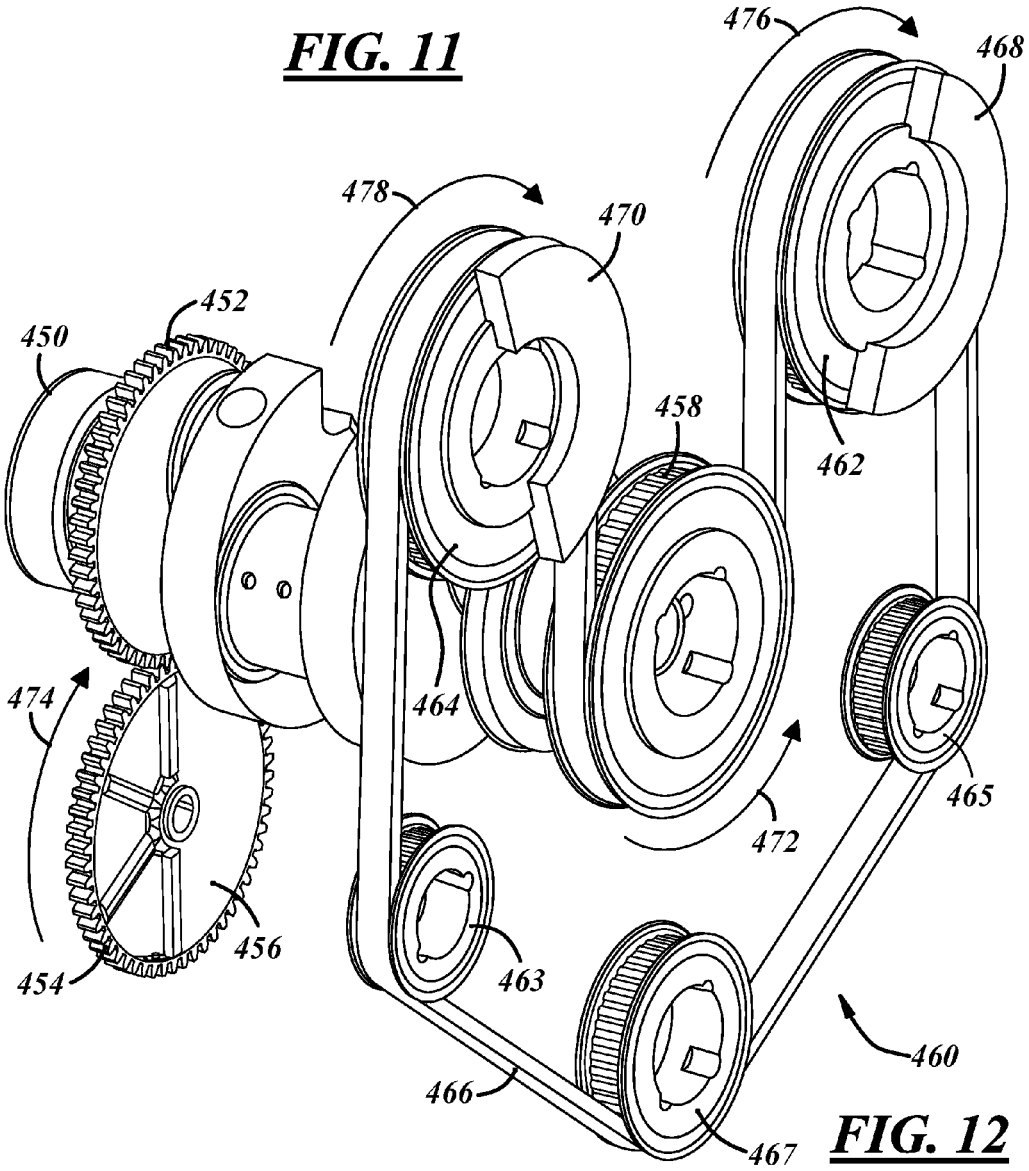
FIG. 12 is an isometric representation of an accessory drive to improve balancing.

Referring now to FIG. 12, an isometric representation of an accessory drive for an internal combustion engine is shown. Crankshaft 450 has a gear 452 that engages with a gear 454 that couples to an oil pump or other accessory (not shown). A counterweight 456 is coupled to gear wheel 454. Crankshaft 450 is also coupled to a pulley 458 that is part of a front end accessory drive system 460. A belt 466 engages with multiple pulleys 462, 463, 464, 465, and 467. Pulleys 462, 463, 464, 465, and 467 may be coupled to additional accessories such as: an air-conditioning compressor, a power-steering pump, and a water pump. Some of the pulleys may be idler pulleys. Furthermore, at least one belt tensioner may be included in the system. A counterweight 470 is applied to pulley 464 and a counterweight 468 is applied to pulley 468. Pulleys 464 and 468 are the same diameter as pulley 458 so that pulleys 464 and 468 counterrotate at crank speed. Gear 454 has the same number of teeth as gear 452 so that gear 454 counterrotates at crankshaft speed.

Crankshaft 450 rotates counter clockwise in FIG. 12 as shown by arrow 472. Gear 454, pulley 462, and pulley 464, rotate clockwise, as shown by arrows 474 and 476, and 478 thereby facilitating the counterweights associated with the gear and/or pulleys to counteract the imbalance in a direction orthogonal to the axis of the cylinders and the axis of rotation of the crankshaft created by the counterweighting of the crankshaft.

The counterweight(s) (i.e., offset of the center of gravity) applied to crankshaft 460 overcomes about one-half of the inertia force imbalance of the pistons in the axial direction of the cylinders but introduces an inertia force imbalance in an orthogonal direction. Counterweight 456 on gear 454 is sized to overcome about one-quarter of the inertia force imbalance due to reciprocation of the pistons in the axial direction of the pistons. And, because gear 454 rotates in an opposite direction from crankshaft 460, it overcomes about one-half of the orthogonal imbalance introduced by a counterweight on crankshaft 460. Counterweights 468 and 470 on pulleys 462 and 464, respectively, are sized to overcome about one-eighth of the inertia force imbalance due to reciprocation of the pistons. Again, because pulleys 462 and 464 rotate in the opposite sense of crankshaft 60, they collectively overcome about one-half of the orthogonal imbalance introduced by a counterweight on crankshaft 460. The engine is balanced with the set of counterweights as described.

Figure 11:
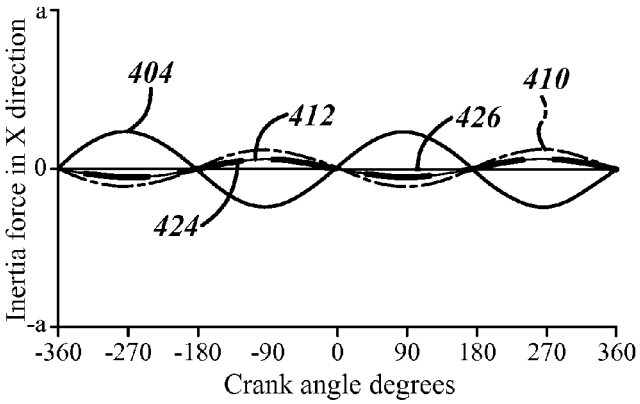
FIG. 11 is a graph of inertia force in the axial direction of the cylinders for the unbalanced OPOC, the effects of adding a counterweight on the crankshaft and on engine accessories, and the resulting inertia forces when the counterweights are applied.

Referring back to FIG. 11, the imbalance due to counter weights 468 and 470 is shown as curve 412 and the imbalance due to counterweight 456 is shown as curve 424. By summing curves 404, 410, 412, and 424, the resultant curve is 426, which shows that the balance is perfect or nearly perfect.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

I claim:

1. An internal combustion engine, comprising:

a crankshaft;

a block into which the crankshaft is mounted, the block defining two cylinders wherein a first of the two cylinders is arranged substantially opposite a second of the two cylinders with respect to the crankshaft and a central axis of the first cylinder is offset from a central axis of the second cylinder by a predetermined distance;

a first intake piston and a first exhaust piston inserted into the first cylinder with the first exhaust piston closer to the crankshaft than the first intake piston;

a second intake piston and a second exhaust piston inserted into the second cylinder with the second exhaust piston closer to the crankshaft than the second intake piston;

a first pushrod that couples between a central journal of the crankshaft and the first exhaust piston; and a second pushrod that couples between the central journal of the crankshaft and the second exhaust piston wherein:

the first pushrod and the second pushrod are adjacent to each other;

a portion of the central journal to which the first pushrod couples and a portion of the central journal to which the second pushrod couples are collinear; and the predetermined distance that the cylinders are offset is substantially equal to a distance between the pushrods taken along an axis of rotation of the crankshaft.

2. The engine of claim 1 wherein the crankshaft is a unitary crankshaft and has at least five journals:

a central eccentric journal;

a front eccentric journal;

a rear eccentric journal;

a front main journal having an axis of rotation collinear with an axis of rotation of the crankshaft;

a rear main journal having an axis of rotation collinear with an axis of rotation of the crankshaft;

the front and rear eccentric journals have a substantially identical crank throw and substantially equal phasing; and the central journal has a crank throw greater than the crank throw of the front and rear eccentric journals and is offset between 450 to 180 degrees with respect to the front and rear eccentric journals.

3. The engine of claim 2, further comprising:

a first pair of shell bearings placed on the central journal with the first pair of shell bearings located between the central journal and the first pushrod; and a second pair of shell bearings placed on the central journal with the second pair of shell bearings located between the central journal and the second pushrod wherein the first pair of shell bearings is adjacent to the second pair of shell bearings.

4. The engine of claim 2, further comprising:

a pair of shell bearings placed on the central journal wherein the first and second pushrods are coupled to the outer surface of the shell bearings.

5. The engine of claim 4 wherein at least one of the pair of shell bearings includes an outwardly extending tab; the first pushrod has a pocket defined on a surface of the first pushrod that nests with the shell bearings; and the tab engages with the pocket.

6. The engine of claim 1 wherein the crankshaft has at least five journals:

a central eccentric journal;

a front eccentric journal;

a rear eccentric journal;

a front main journal having an axis of rotation collinear with an axis of rotation of the crankshaft; and a rear main journal having an axis of rotation collinear with the axis of rotation of the crankshaft, the engine further comprising:

a first rear pullrod that couples between the rear journal of the crankshaft and the first intake piston;

a first front pullrod that couples between the front journal of the crankshaft and the first intake piston;

a second rear pullrod that couples between the rear journal of the crankshaft and the second intake piston; and a second front pullrod that couples between the front journal of the crankshaft and the second intake piston.

7. The engine of claim 6, further comprising:

a first rear pair of shell bearings placed on the rear journal with the first rear pair of shell bearings located between the rear journal and the first rear pullrod;

a second rear pair of shell bearings placed on the rear journal with the second rear pair of shell bearings located between the rear journal and the second pullrod wherein the first rear pair of shell bearings is adjacent to the second rear pair of shell bearings;

a first front pair of shell bearings placed on the front journal with the first front pair of shell bearings located between the front journal and the first front pullrod; and a second front pair of shell bearings placed on the front journal with the second front pair of shell bearings located between the front journal and the second pullrod wherein the first front pair of shell bearings is adjacent to the second front pair of shell bearings.

8. The engine of claim 6, further comprising:

a rear pair of shell bearings placed on the central journal wherein the first and second rear pullrods are coupled to the outer surface of the rear pair of shell bearings; and a front pair of shell bearing placed on the central journal wherein the first and second front pullrods are coupled to the outer surface of the front pair of shell bearings.

9. The engine of claim 8 wherein at least one of the rear pair of shell bearings includes an outwardly extending tab;

the first rear pullrod has a pocket defined on a surface of the first rear pullrod that nests with the shell bearings;

the tab associated with the rear pair of shell bearings engages with the pocket associated with the first rear pullrod;

at least one of the front pair of shell bearings includes an outwardly extending tab;

the first front pullrod has a pocket defined on a surface of the first front pullrod that nests with the shell bearings; and the tab associated with the front pair of shell bearings engages with the pocket associated with the first front pullrod.

10. An internal combustion engine, comprising:

a unitary crankshaft;

a block into which the crankshaft is mounted, the block defining two cylinders wherein a first of the two cylinders is arranged substantially opposite a second of the two cylinders with respect to the crankshaft;

two substantially identical inner pistons, one of which is inserted into the first cylinder and the other of which is inserted into the second cylinder;

two substantially identical outer pistons, one of which is inserted into the first cylinder and the other of which is inserted into the second cylinder wherein the inner pistons are located nearer the crankshaft than the two outer pistons and a central axis of the first cylinder is offset from a central axis of the second cylinder by a predetermined distance;

a first pushrod that couples between a central journal of the crankshaft and the inner piston in the first cylinder;

a second pushrod that couples between the central journal of the crankshaft and the inner piston in the second cylinder wherein the first pushrod and the second pushrod are adjacent to each other and the predetermined distance is substantially equal to a distance that first and second pushrods are displaced from each other taken along a central axis of the crankshaft;

a first pullrod that couples between a front eccentric journal of the crankshaft and the outer piston in the first cylinder;

a second pullrod that couples between the front eccentric journal of the crankshaft and the outer piston in the second cylinder;

a third pullrod that couples between a rear eccentric journal of the crankshaft and the outer piston in the first cylinder; and a fourth pullrod that coupled between the rear eccentric journal of the crankshaft and the outer piston in the second cylinder, wherein the first pullrod and the second pullrod are adjacent to each other and the predetermined distance is substantially equal to a distance that first and second pullrods are displaced from each other taken along the central axis of the crankshaft and wherein the third pullrod and the fourth pullrod are adjacent to each other and the predetermined distance is substantially equal to a distance that third and fourth pullrods are displaced from each other taken along the central axis of the crankshaft;

wherein reciprocation of the pistons, pushrods, and pullrods produces an imbalance along the direction of reciprocation of the pistons;

and wherein the crankshaft defines a first web between the center journal and the front eccentric journal and a second web between the center journal and the rear eccentric journal, the first and second webs weighted to displace a center of gravity of the crankshaft from an axis of rotation of the crankshaft sufficiently to overcome about one-half of the imbalance along the direction of reciprocation of the pistons.

11. The engine of claim 10 wherein the inner pistons are one of: intake pistons and exhaust pistons.

12. The engine of claim 10 wherein a plurality of ports are defined in each of the two cylinders:

an inner plurality of ports that are located a first predetermined distance from the crankshaft; and an outer plurality of ports that are located a second predetermined distance from the crankshaft with the second predetermined distance being more than double the first predetermined distance.

13. The engine of claim 12, further comprising:

a first manifold system fluidly coupled to the inner pluralities of ports; and a second manifold system fluidly coupled to the outer pluralities of ports.

14. The engine of claim 10 wherein:

the predetermined distance that the central axis of the first cylinder is offset from the central axis of the second cylinder is measured in a direction along an axis of rotation of the crankshaft;

the inner pistons are adapted to reciprocate within their respective cylinders between a bottom center position at which they are closest to the crankshaft and a top center position at which they are farthest away from the crankshaft;

the outer pistons are adapted to reciprocate within their respective cylinders between a top center position at which they are closest to the crankshaft and a bottom center position at which they are farthest away from the crankshaft;

an inner plurality of ports are defined in the cylinders at a first predetermined distance from the crankshaft with the inner plurality of ports proximate a top of the associated inner piston when the inner piston is at its bottom center position; and an outer plurality of ports are defined in the cylinders at a second predetermined distance from the crankshaft with the outer plurality of ports proximate a top of the associated outer piston when the outer piston is at its bottom center position.

15. The engine of claim 10 further comprising:

a gear rotatably coupled to the crankshaft to counter rotate relative to a direction of rotation of the crankshaft; and a first counterweight coupled to the gear, the first counterweight configured to overcome about one-quarter of the imbalance along the direction of reciprocation of the pistons.

16. The engine of claim 15 further comprising:

a first pulley coupled to the crankshaft to rotate in the direction of rotation of the crankshaft;

a flexible member engaged with the first pulley;

a second pulley engaged with the flexible member to counter rotate relative to the direction of the crankshaft; and a second counterweight coupled to the second pulley, the second counterweight configured to overcome about one-eighth of the imbalance along the direction of reciprocation of the pistons.

17. The engine of claim 16 further comprising:

a third pulley engaged with the flexible member to counter rotate relative to the direction of the crankshaft; and a third counterweight coupled to the third pulley, the third counterweight configured to overcome about one-eighth of the imbalance along the direction of reciprocation of the pistons.

18. The engine of claim 10 wherein the weighted first and second webs introduce an inertia force imbalance in a direction orthogonal to the direction of reciprocation of the pistons;

and further comprising:

at least one of a first gear and at least one pulley driven by the crankshaft to counter rotate relative to a direction of rotation of the crankshaft; and at least one counterweight coupled to the at least one of the first gear and the at least one pulley, the at least one counterweight counter rotating relative to the direction of rotation of the crankshaft configured to overcome at least a portion of the inertia force imbalance in the direction orthogonal to the direction of reciprocation of the pistons.

* * * * *